US008607480B2

(12) United States Patent
Vuistiner

(10) Patent No.: US 8,607,480 B2
(45) Date of Patent: Dec. 17, 2013

(54) EARTH MOVING BUCKET

(76) Inventor: Serge Vuistiner, St-Martin (CH)

( * ) Notice: Subject to any disclaimer, the term of this patent is extended or adjusted under 35 U.S.C. 154(b) by 319 days.

(21) Appl. No.: 12/998,831

(22) PCT Filed: Nov. 30, 2009

(86) PCT No.: PCT/IB2009/055412

§ 371 (c)(1),
(2), (4) Date: Aug. 8, 2011

(87) PCT Pub. No.: WO2010/064188

PCT Pub. Date: Jun. 10, 2010

(65) Prior Publication Data

US 2011/0283571 A1 Nov. 24, 2011

(30) Foreign Application Priority Data

Dec. 5, 2008 (EP) ..... 08170866

(51) Int. Cl.
*B66C 3/00* (2006.01)
*E21D 1/00* (2006.01)

(52) U.S. Cl.
USPC ..... 37/187; 414/625

(58) Field of Classification Search
USPC ..... 37/398, 444, 184–188, 461; 294/112, 294/86.41, 68.23; 414/726, 625, 626, 735, 414/739
See application file for complete search history.

(56) References Cited

U.S. PATENT DOCUMENTS

| | | | | | |
|---|---|---|---|---|---|
| 443,993 | A | * | 1/1891 | Henry | 37/398 |
| 1,794,257 | A | * | 2/1931 | Thompson | 37/184 |
| 2,314,395 | A | * | 3/1943 | Harrington | 37/186 |
| 2,486,479 | A | * | 11/1949 | Kennedy | 414/726 |
| 2,621,428 | A | * | 12/1952 | Billings | 37/187 |
| 3,695,473 | A | * | 10/1972 | Martin | 414/625 |
| 4,047,313 | A | * | 9/1977 | Bricon | 37/187 |
| 5,199,194 | A | * | 4/1993 | Scott | 37/340 |
| 5,762,390 | A | | 6/1998 | Gosselin et al. | |

FOREIGN PATENT DOCUMENTS

| | | | |
|---|---|---|---|
| DE | 590 683 | C | 1/1934 |
| DE | 11 23 097 | B | 2/1962 |
| DE | 11 14 623 | B | 10/1998 |
| EP | 0 054 207 | A | 6/1982 |
| EP | 0 256 304 | A | 2/1988 |

* cited by examiner

*Primary Examiner* — Robert Pezzuto
(74) *Attorney, Agent, or Firm* — Krieg DeVault LLP; Clifford W. Browning

(57) ABSTRACT

The two jaws of the bucket each consist of two rigid portions, the receptacle and the shovel, which are hinged onto on another around the pivoting axis. They are connected to the chassis and to the control cylinder by the suspension arm and the moving arm. The hinges of each jaw between the receptacle, the shovel, the suspension arms, the moving arms, the cylinder, and the chassis imply four hinged systems, each having four push rods. During a closing movement of the bucket from the position of maximum separation of the jaws, a relative pivoting of limited amplitude occurs in alternating directions between the receptacle and the shovel of each jaw.

8 Claims, 7 Drawing Sheets

EARTH MOVING BUCKET

This application claims the benefits under 35 U.S.C. 119 (a)-(d) or (b), or 365(b) of International Application No. PCT/IB2009/055412, filed 30 Nov. 2009, and European Patent Application No. 08170866.1, filed 5 Dec. 2008.

TECHNICAL FIELD

The present invention relates to an earth moving bucket.

STATE OF THE ART

Earth moving buckets are known that comprise two jaws articulated on a chassis about spindles that are in parallel with and spaced apart from each other, these buckets being suspended on an apparatus such as a crane, truck, building machine, earth moving machinery. The jaws are controlled by one or several actuators housed in the chassis. The wide variety of soil structures in which these buckets can be used and the variety of uses thereof for digging, raking, lifting loads such as stone blocks, moving earth, leveling surfaces, etc. mean that users require these buckets to perform in extremely diverse ways which results in ever more improved designs.

European Patent EP 0256304 published on Mar. 7, 1990, describes a bucket that is capable of a great number of the aforementioned types of work. However, there is still a need to further improve the performance of the bucket described in the aforementioned patent and the present invention aims to achieve the improvements that have proved to be desirable.

DISCLOSURE OF THE INVENTION

To this end, the present invention relates to an earth moving bucket comprising a rigid chassis suspended on earth moving machinery, a main actuator housed in the chassis, two symmetrical jaws controlled by the main actuator and able to be displaced between positions of maximum opening and complete closure, each jaw being supported by two parallel suspension arms pivoting on the chassis around a common suspension spindle, these two spindles being in parallel with and spaced apart from each other on the chassis, each jaw being articulated, at the lower end of its suspension arms, on a pivoting spindle in parallel with the suspension spindles, and being connected to moving arms controlling tipping movements of the jaw on its pivoting spindle during opening or closing movement of the bucket, characterized in that each jaw is formed of two different rigid parts, namely a receptacle and a shovel, each having a base and a flange or a toothing arrangement, these two jaw parts being articulated to each other and to the suspension arms around said pivoting spindle and being further separately connected to the moving arms of the jaw, the shovel by direct articulation to its base, and the receptacle by connections between its base and the moving arms, the control of the jaws being effected by articulated systems with four push rods that connect the suspension and moving arms to the chassis and to the actuator and that are shaped and sized such that between the shovel and the receptacle of each jaw there is produced a relative pivoting movement on said pivoting spindle, of limited amplitude and in alternating directions during complete opening or closing movement of the bucket.

Important features of the earth moving bucket in accordance with the invention are defined in the accompanying dependent claims.

BRIEF DESCRIPTION OF THE DRAWINGS

One embodiment of the subject matter of the invention will be described hereinafter by way of non-limiting example and is illustrated in the accompanying drawings, in which.

DETAILED DESCRIPTION OF AN EMBODIMENT OF THE INVENTION

Figure 1:
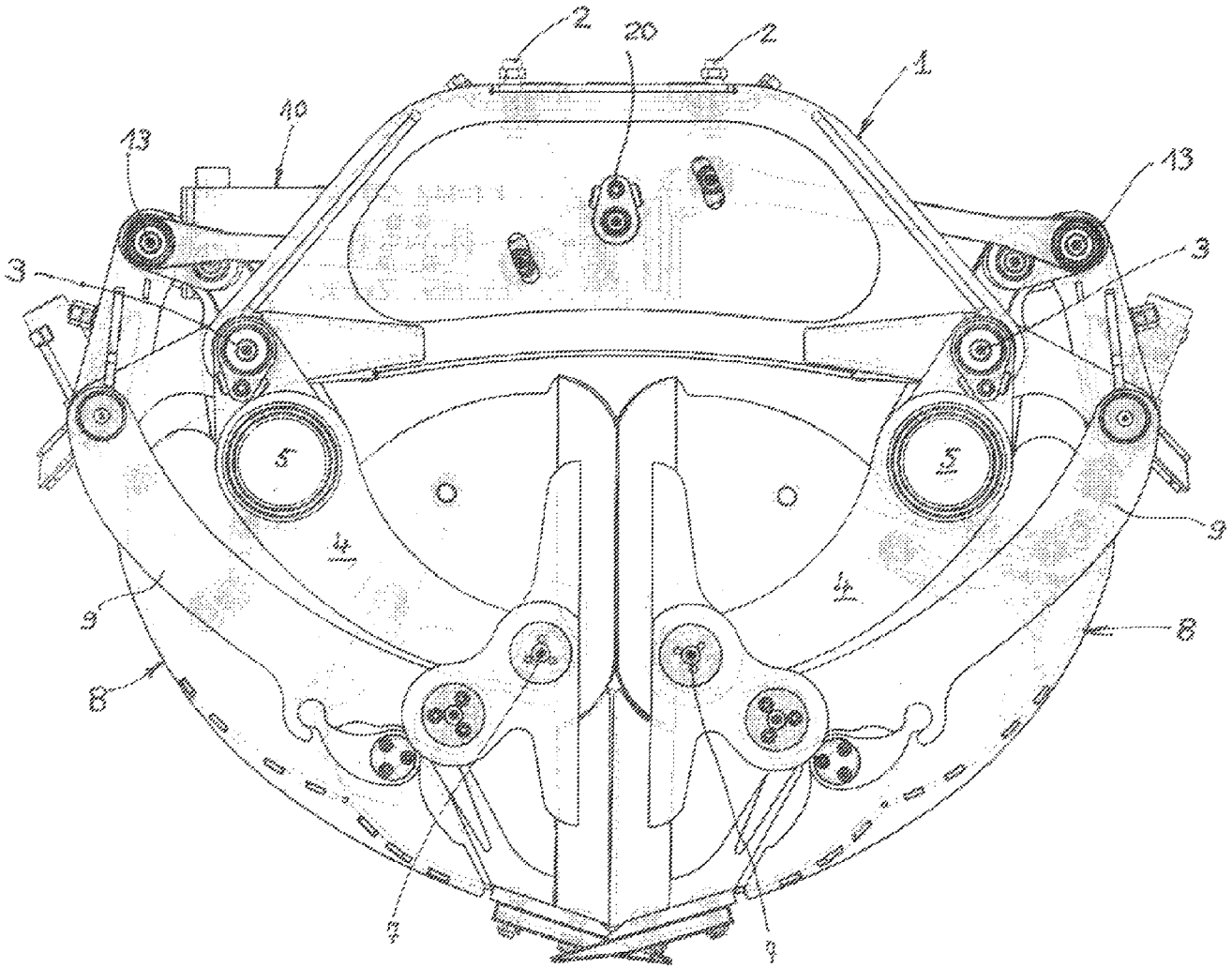
FIG. 1 is a front elevation view of the bucket in the closed position.

FIG. 1 shows the main components of the bucket. A rigid chassis 1 in the form of a prism with trapezoidal faces is provided on its upper side with hydraulic power supply members 2 and coupling members (not shown) for connecting the bucket to a control arm of an apparatus such as a truck, crane or building machine in accordance with the usual technique. This chassis is fitted in the lower corners of its structure with two parallel spindles 3 that are perpendicular to its front faces, these spindles being formed by pivoting members such as bearings or shafts, or provided with reinforcing members that do not need to be described here. The spindles 3 are suspension spindles on each of which the upper ends of two suspension arms 4 pivot. The chassis thus supports two pairs of suspension arms that are disposed on each of its front faces and are parallel and slightly curved towards the centre. Located between the suspension arms of each pair, in proximity to their upper end, is a sturdy tubular member 5 that rigidly connects the arms of the pair to each other and also fulfils a stop function as will be described hereinafter. At their lower end, the two suspension arms 4 of each pair support articulation members 6 that will be described in detail hereinafter that are coaxial, define a pivoting spindle 7 in parallel with the spindles 3 and provide for the suspension of one of the jaws 8 of the bucket on the common spindle of the members 6 whilst allowing pivoting thereof.

It can be seen in the drawing that arms 9 are disposed in proximity to each of the suspension arms 4. There are four moving arms, two per jaw 8, placed on the outer faces of the jaws. Before describing their functions, the arrangement of the main actuator 10 best seen in FIG. 2 will be shown. This actuator is housed within the chassis 1 in a longitudinal position. In the illustrated embodiment, it is a hydraulic actuator having a cylinder 11 in which a rod 12 slides. Its extension or withdrawal will be controlled by the operator of the bucket. Mounted at the end of the rod 12 and on the bottom of the cylinder 11 are members that form at these two locations two articulation spindles 13 that are perpendicular to the faces of the chassis and therefore in parallel with the suspension 3 and pivoting 7 spindles. It is now easy to see, in particular from FIG. 2, that disposed between the articulation spindles 13 of the rod and of the cylinder of the actuator and the suspension spindles 3 of the suspension arms 4 are articulated systems with four push rods 14, 15, 16, 17, the push rod 14 being fixedly attached to the suspension arm 4 located on the same side and oriented in its extension. The push rods 14 and 15 are articulated to each other at their ends opposite those that connect them respectively to the suspension spindles 3 and end spindles 13 of the rod of the actuator or of the bottom of the cylinder. The same arrangement is repeated for the push rods 16 and 17 pivoting on each other and on the arm 9 along the spindle 13*a*. This, upon extension of the actuator 10, the arms 4 of the jaw on the right-hand side in FIG. 2 pivot in the clockwise direction and those of the jaw on the left-hand side pivot in the opposite direction. Similarly, the articulation 13*a* that is also that of the moving arms 9 moves in the aforementioned case in the clockwise direction and the moving arms describe a downwards movement, the articulations 13*a* remaining at a constant distance from the suspension spindles 3.

Figure 2:
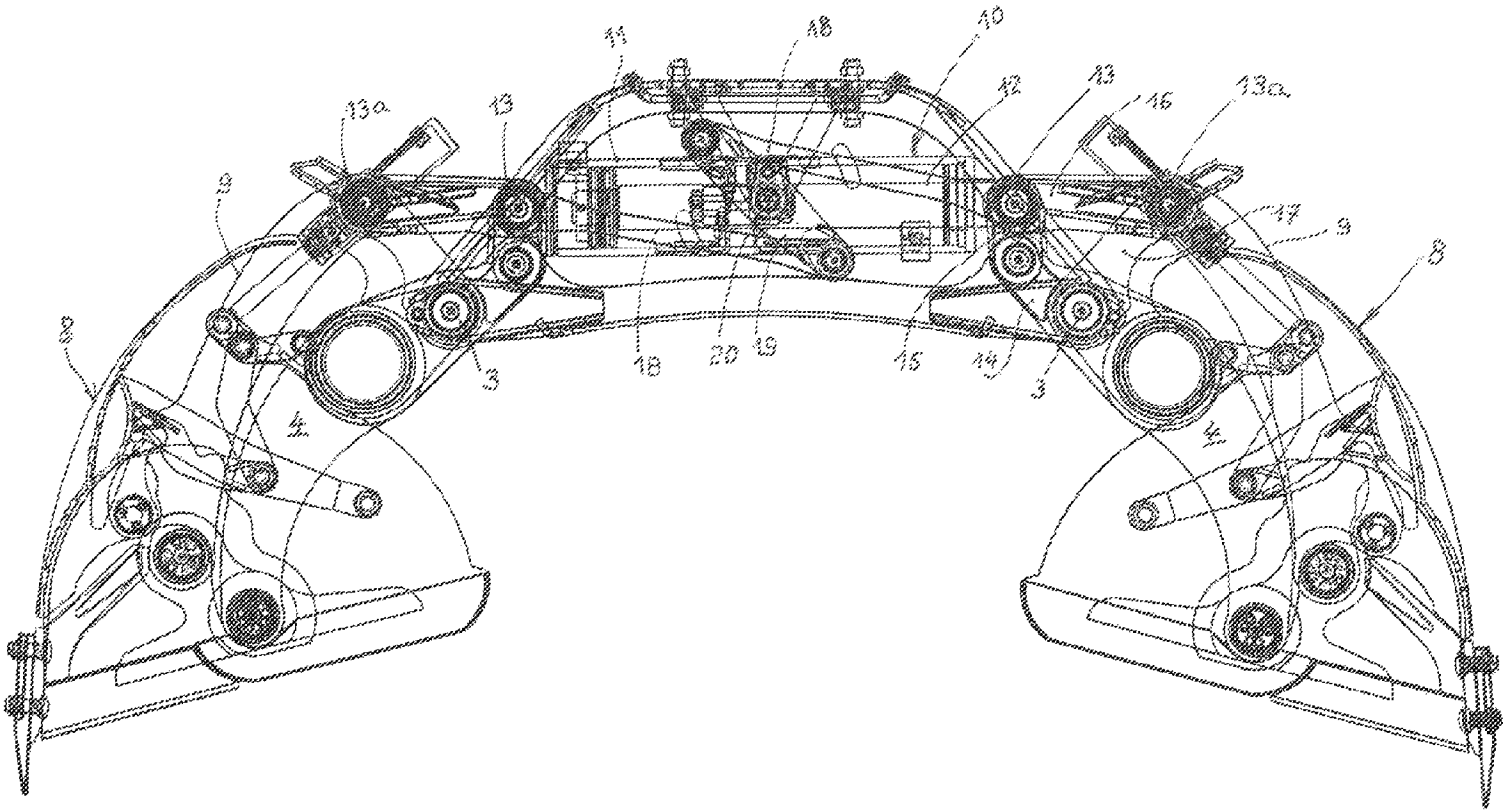
FIG. 2 is a vertical cross-sectional view of the bucket in the fully open position.
Figure 3:
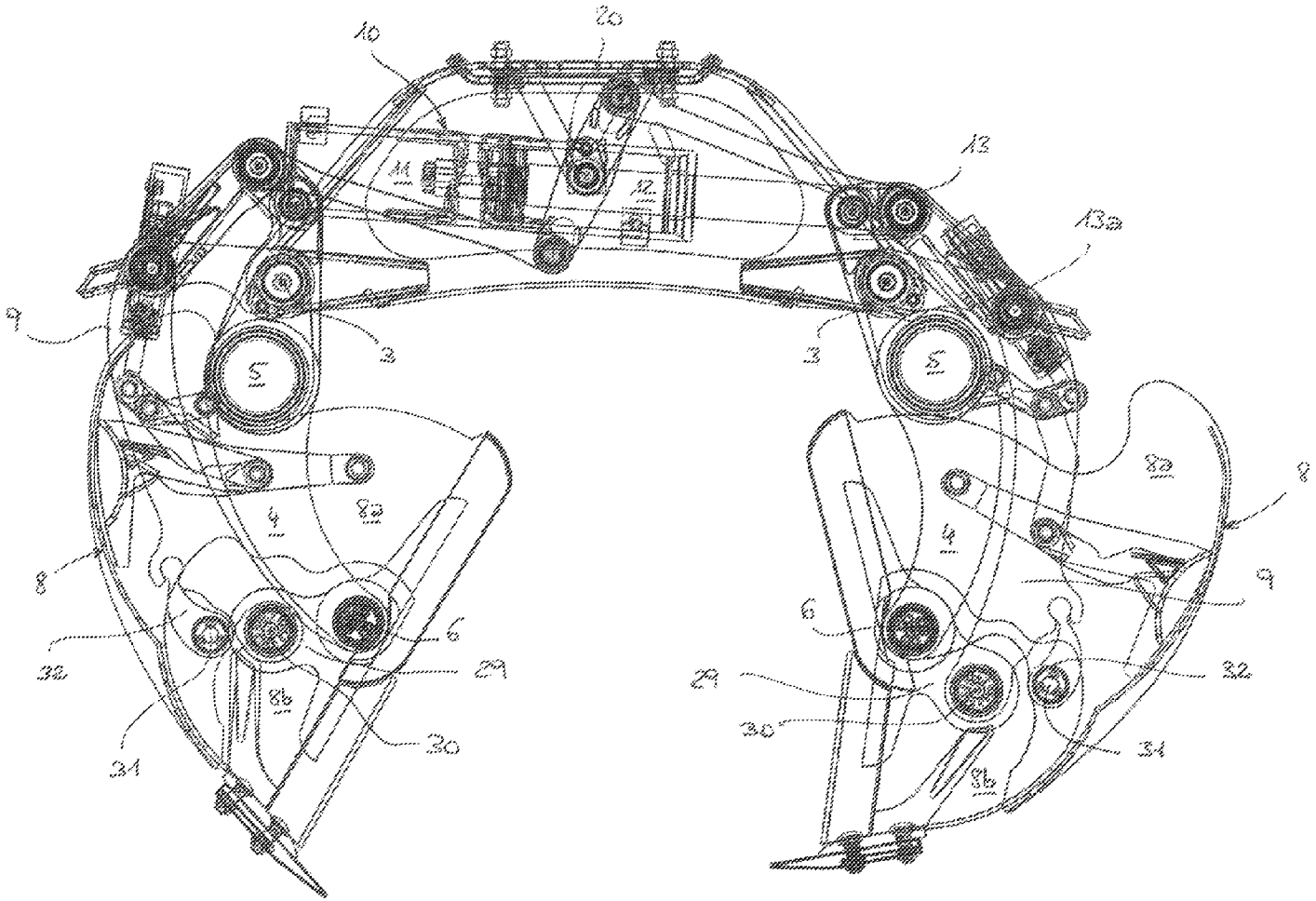
FIG. 3 is a view similar to FIG. 2 of the bucket in an intermediate position.

The actuator 10 is indirectly connected to the chassis 1. Two co-ordination bars 18 are each articulated, at one end, to one of the spindles 13 and are connected at their other end by a tie-rod 19 whose central part is itself articulated to the centre of the lateral face of the chassis 1 by an articulation 20. This indirect connection between the chassis and the actuator allows the latter to move in dependence upon the force system imposed upon the rod 12 and the cylinder 11 of the actuator 10. FIG. 1 shows the maximum extended position of the actuator 10 with the two jaws 8 bearing against each other in the fully closed position. FIG. 2 shows the maximum withdrawn position of the actuator 10 with the two jaws being symmetrically open and FIG. 3 shows an intermediate position in which the jaws are in asymmetric positions. It can be seen that in this position, the actuator 10 is offset in the chassis with respect to its normal position.

Figure 4:
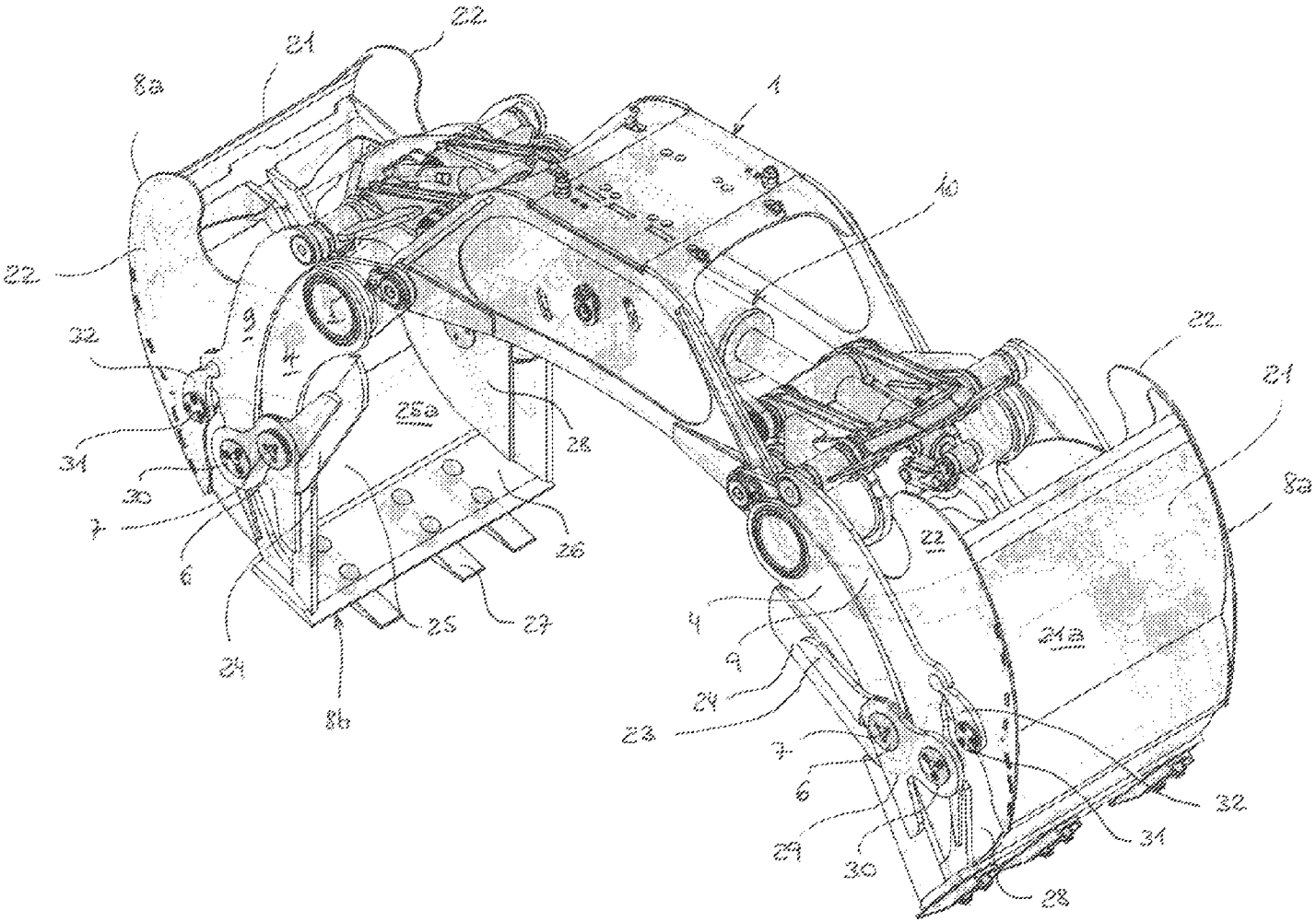
FIG. 4 is a perspective view of the bucket in the position of FIG. 3.

By comparing FIGS. 2 and 3, it can be seen that the extension of the actuator 10 has caused the suspension arms 4 and moving arms 9 to rotate in the reverse direction and caused the jaws to move closer together. The jaws 8 are formed of two rigid parts articulated to each other along the pivoting spindle 7 that is common to these two parts and to the suspension arms 4. By comparing the left and right jaws 8 in FIG. 3, it can be seen that the two parts of the right-hand jaw have undergone a relative pivoting movement with limited amplitude with respect to each other whilst the left-hand jaw has moved as if it were a single piece. The two mobile parts will henceforth be called a receptacle 8*a* and a shovel 8*b*. The receptacle 8*a* comprises (FIG. 4) a curved bottom 21 and two side walls 22 whose outline is cut for a reason to be explained hereinafter, reinforced by articulation rings 6, 30, 31 that have already been defined, thus forming a base 21*a* and flanges 24 also provided with a reinforcing plate. The shovel 8*b* comprises, for its base 25*a*, a curved bottom 25 extended by a blade 26. This is provided with teeth 27. Side walls 28 of the base 25*a* engage within walls 22 of the receptacle and are reinforced at the pivoting spindle 7 by plates 29 cut into a V. The plates 29 have an extension that, as can be seen in FIGS. 3 and 4, supports a ring 30 for articulating the shovel 8*b* to the moving arm 9. Another pair of articulation rings 31 fixedly attached to pivoting spindles connects the curved push rods 32 having a head-shaped extension to the flanks 22 of the receptacles. The heads of the push rods 32 are engaged in side notches of the moving arms 9. FIG. 3 shows that the articulation spindles of the rings 6, 30 and 31 are aligned with the left-hand jaw and draw a broken line to the right-hand jaw resulting in relative rotation of the two jaw parts owing to differentiated movements of the arms 4 and 9 during control of the actuator 10 between the positions of FIGS. 2 and 3.

Figure 6:
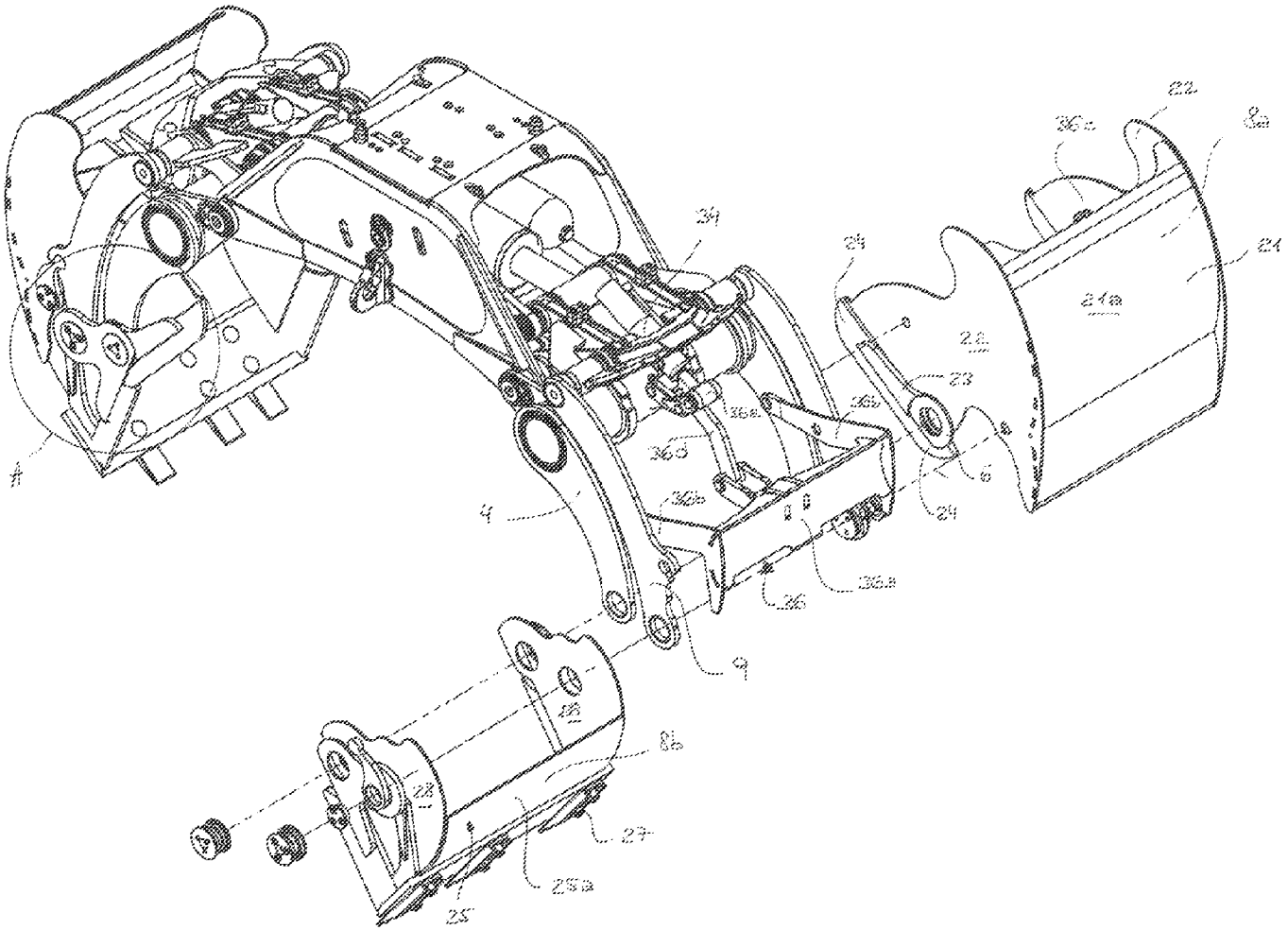
FIG. 6 is an exploded perspective view of the bucket in the open position.
Figure 7:
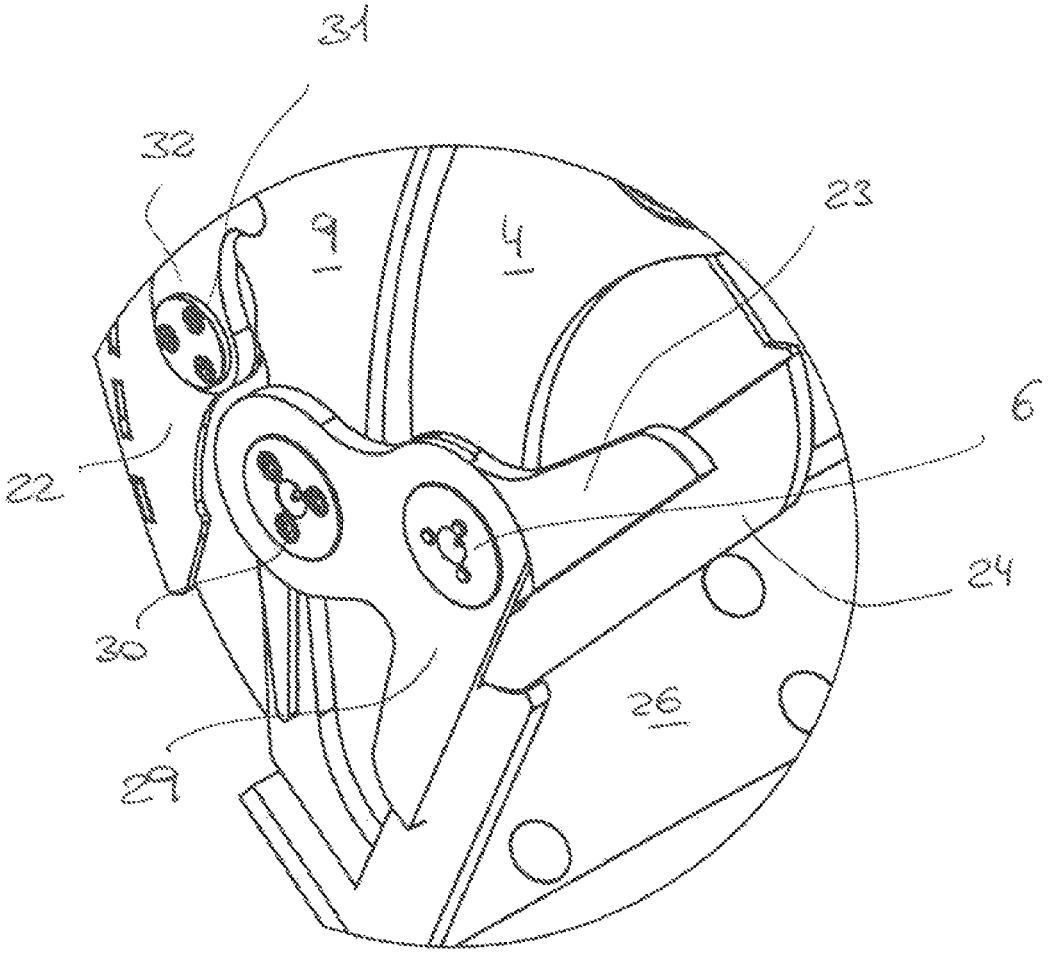
FIG. 7 is a detailed view of the articulations of the parts of a jaw on the suspension and moving arms.

The exploded FIG. 6 and the detailed view 7 explain the functions of the moving arms 9. Reference will also be made to FIGS. 1 to 4. In addition to the actuator 10, the control device of the bucket further has a second actuator 34 whose cylinder is mounted on the articulation spindle 13*a* common to the push rods 16 and 17 for the same purpose as that disclosed in patent EP 0256304 but whose action is effected mainly on the receptacle part 8*a* of the jaws. This auxiliary actuator 34 can be a spring actuator or a hydraulic actuator. If necessary, it can be connected to the actuator 10 and controlled from the apparatus bearing the bucket. As a reminder, the flanks 22 of the jaws 8 are cut with a deep indentation whose radius corresponds to that of the sturdy tube 5 incorporated on the suspension arms 4. In the open position of the jaws (FIG. 2), these indentations bear against the tube segments 5. Pivoting of the receptacles 8*a* during the closing movement of the bucket is modified by the geometric arrangement of the spindles 7, 30 and 31, in particular the different distances of the spindles 30, 31 to the spindle 7. The differentiated movements obtained can be assisted by the action of the auxiliary actuator 34 connected by a secondary rod linkage to the external face of this tube. The indentations of the flanks 22 extend away from the tube 5. In contrast, the action of the moving arm 9 on the shovel 8*b* is exerted with all the force transmitted by the actuator(s). The teeth 27 of the shovel 8*b* will thus have a maximum effect on the ground.

Figure 5:
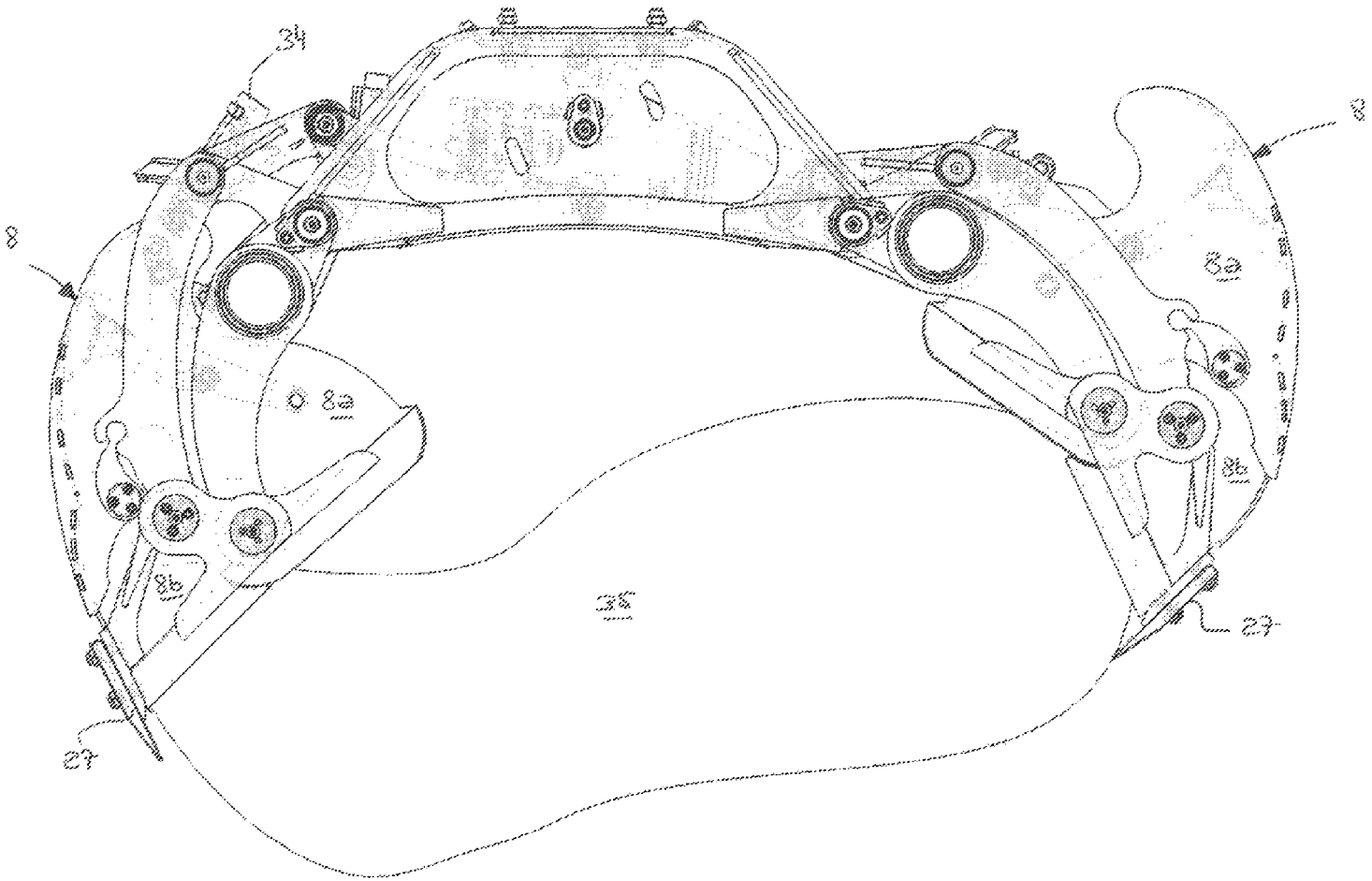
FIG. 5 is an elevation view similar to FIG. 3 showing a block gripped by the bucket.

The effect of this arrangement can be seen in FIG. 5: a rock 35 has been gripped by the left-hand jaw 8 of the bucket, the teeth 27 of the shovel being engaged beneath the left end of the rock 35. The teeth 27 of the shovel 8*b* of the right-hand jaw have hooked the right end of the rock 35 whilst the receptacle 8*a* exhibited a certain pivoting delay such that the rock was protected against a risk of sliding. In this regard, it will be recalled that in the field of use of buckets with articulated jaws the idea of the contact pivoting point between the load and the jaws is important (see patent EP 0256304). With the arrangement described above, in which each jaw is divided into two differently articulated parts, the effect of the pivoting points during the picking up of a load is improved such that the safety of the use of the bucket is greater than is heretofore known.

FIG. 6 also shows an additional element of the bucket. It is an inner raking device 36 that is fitted to the receptacle 8*a* of each of the jaws 8. This device has a curved plate 36*a* fixedly attached to two transverse arms 36*b* in the shape of an L that can be coupled to inner lugs 36*c* fixedly attached to inner faces of the walls 22 of each receptacle 8*a*. A central arm 36*d* with an articulation 36*e* can be coupled to the actuator 34.

The movement of this raking device allows clay or silty waste stuck to the base of the receptacle to be removed.

The invention claimed is:

1. Earth moving bucket comprising a rigid chassis suspended on earth moving machinery, a main actuator housed in the chassis, two symmetrical jaws controlled by the main actuator and able to be displaced between positions of maximum opening and complete closure, each jaw being supported by two parallel suspension arms pivoting on the chassis around a common suspension spindle, these two spindles being in parallel with and spaced apart from each other on the chassis, each jaw being articulated, at the lower end of its suspension arms, on a pivoting spindle in parallel with the suspension spindles, and being connected to moving arms controlling tipping movements of the jaw on its pivoting spindle during opening or closing movement of the bucket, wherein each jaw is formed of two different rigid parts, namely a receptacle and a shovel, each having a base and a flange or a toothing arrangement, these two jaw parts being articulated to each other and to the suspension arms around said pivoting spindle and being further separately connected to the moving arms of the jaw, the shovel by direct articulation to its base, and the receptacle by connections between its base and the moving arms, the control of the jaws being effected by articulated systems with four push rods that connect the suspension and moving arms to the chassis and to the actuator and that are shaped and sized such that between the shovel and the receptacle of each jaw there is produced a relative pivoting movement on said pivoting spindle, of limited amplitude and in alternating directions during complete opening or closing movement of the bucket.

2. Bucket according to claim 1, wherein the actuator comprises a mobile rod controlled in a cylinder along the axis thereof, and symmetrically actuates, by the end of the rod and by the bottom of the cylinder, articulation spindles between two push rods of said articulated systems so as to control the suspension arms and moving arms of the two jaws, one of the push rods of each system being directly fixedly attached to the corresponding suspension arm such that any movement of the actuator moves the suspension arms of the two jaws in circular arcs centered on said suspension spindles.

3. Bucket according to claim 2, wherein two co-ordination bars are articulated by one end, one on the bottom of the cylinder and the other on the end of the rod of the actuator, the spindles of these articulations being the same as for said pairs of push rods controlling the arms, and wherein at their other end these co-ordination bars are connected to each other by a rigid tie-rod whose central point is connected by an articulation to one of the lateral faces of the chassis, the actuator not having another connection to the chassis.

4. Bucket according to claim 2, wherein in each of said articulated systems with four push rods, two rigid push rods articulated to each other by one end are articulated by their other end, one on the suspension spindle and the other on said articulation spindle between one end of the actuator and a co-ordination bar.

5. Bucket according to claim 4, wherein in each of said articulated systems with four push rods, an articulation spindle common to two pairs of push rods, one of each being connected to the suspension spindle and the others being connected to the end of the rod of the actuator, is also an articulation spindle of the upper ends of the moving arms such that during any opening or closing movement of the jaws of the bucket, the upper parts of the moving arms move in a circular arc at a constant distance from the suspension spindle.

6. Bucket according to claim 5, wherein in the control of each jaw the articulation spindle on which the upper end of the moving arms pivots supports an auxiliary actuator that is automatically controlled or whose control is connected to the main actuator and that is intended to reinforce the action of connection between the moving arms and the receptacle of the jaw and to actuate a raking device within the jaw.

7. Bucket according to claim 1, wherein in each jaw, the base of the receptacle has a curved bottom two side walls engaged in the space between the equivalent suspension arms and moving arms, a flange element being connected by a connection piece to the articulation body centered on the pivoting spindle, the shovel having in its base a curved bottom extended by a plate supporting teeth as well as on its two side walls V shaped reinforcement pieces each provided with two articulation rings respectively being used for articulation, around the pivoting spindle, of the shovel and of the receptacle, and of the shovel on the moving arms.

8. Bucket according to claim 1, wherein the arrangement of the push rods and connections of the suspension arms and moving arms with said parts of the jaws is such that the shovels of said jaws are able to retain a load between the jaws the bucket by the adjustment of the pivoting point determined by the contact force of said load with the parts of each jaw, the shovels undergoing relative pivoting of limited amplitudes with respect to the receptacles in each jaw during movement.

* * * * *